United States Patent [19]

Kuo

[11] Patent Number: 5,077,707

[45] Date of Patent: Dec. 31, 1991

[54] TIME SETTING DEVICE FOR AN ALARM CLOCK

[76] Inventor: Davis Kuo, No. 4, Shin-Ho Rd., Tainan City, Taiwan

[21] Appl. No.: 711,140

[22] Filed: Jun. 6, 1991

[30] Foreign Application Priority Data

Dec. 7, 1990 [TW] Taiwan ..... 79213571

[51] Int. Cl.[5] ..... G04B 23/02; G04C 21/16

[52] U.S. Cl. ..... 368/74; 368/250; 368/254

[58] Field of Search ..... 368/72–74, 368/185, 187, 250, 252, 254

[56] References Cited

U.S. PATENT DOCUMENTS

| | | | |
|---|---|---|---|
| 3,708,973 | 1/1973 | Funaki | 368/250 |
| 4,069,658 | 1/1978 | Ito | 368/254 |
| 4,371,267 | 2/1983 | Ogihara et al. | 368/74 |
| 4,376,994 | 3/1983 | Ogihara et al. | 368/254 |

*Primary Examiner*—Vit W. Miska

*Attorney, Agent, or Firm*—Cushman, Darby & Cushman

[57] ABSTRACT

A circular plate used in a time setting device has a through-hole, a plurality of arched protrusions extending downward from the bottom of the same and a pair of arched projections extending upward from the periphery of the through-hole. Each arched protrusion has a first edge spaced parallelly apart from the bottom of the circular plate and a pair of second edges which converge to the free ends of the first edge.

2 Claims, 3 Drawing Sheets

TIME SETTING DEVICE FOR AN ALARM CLOCK

BACKGROUND OF THE INVENTION

1. FIELD OF INVENTION

The invention relates to an alarm setting device, more particularly to an alarm setting device of a table clock which device can be produced by a simple mold and cheap manufacturing cost.

2. DESCRIPTION OF THE RELATED ART

It is a common knowledge that a clock generally includes a counting mechanism consisting of a gear train with calibrated dial and indicating hands. A modern clock even consists of a device which can give out an alarm at a preset time. The device includes a hand rotatable by a connecting wheel ( hereon referred to as a time setting wheel). To set a time, one has to turn the setting wheel in an clockwise direction. Often the hand is rotated beyond a predetermined place, in which situation the hand has to be turned a full rotation in order to reach said predetermined place again.

To remedy this drawback, a new time setting device has been invented, in which the hand to set a predetermined time can be turned clockwise or anti-clockwise directions. FIG. 1 shows a time setting device of prior art model. Accordingly, it includes a setting wheel (B) having a recess (B1) thereon, an hour indicating wheel (C) having a groove with a vertical end (C1)1 and an inclined end (C12), a circular plate (D) having a protrusion (D1) extending downward therefrom and a compressed plate (E) having one edge pivoted to a socket in a housing (A). The protrusion (D1) has a vertical side (D11) and an inclined side (D12). The setting wheel is rotated to stop at a predetermined place, that is, the particular time we wish to be. The hour indicating wheel (C) will rotate in a clockwise direction. While in rotation, the hour indicating wheel (C) pushes the protrusion (D1) of the circular plate (D), moving it in a circle. When the protrusion (D1) of the circular plate (D) reaches the predetermined place of the time setting wheel, the protrusion (D1) falls into the recess (B1), connecting a circuit to give out an alarm, as illustrated in FIG. 2. The connection relationship of the circuit and the alarm system is a known art and is not concerned with the present invention, so that detailed explanation will not be given here.

Because of the tapered side (D12) the protrusion (D1) can get out of the recess (B1) when the hour indicating wheel (C) continues to rotate or when the setting wheel (B) is manually turned in the clockwise direction (shown by an arrow) or alternatively, when the setting wheel (B) is turned in an anti-clockwise direction, as shown in FIG. 2 by a perforated arrow.

A skilled and very precise method is required to make a circular plate with a protrusion (D) having a vertical side (D1)1 which in turn increases the cost of production, since it has a length of only 1mm. Furthermore once the vertical side (D11) is not fully perpendicular to said circular plate, errors in time calculation can occur.

SUMMARY OF THE INVENTION

Therefore, the main object of the present invention is to provide a time setting device which can be produced by a simple mold and at a low manufacturing cost.

Accordingly, this present invention accomplishes feature task by modifying the protrusion of the circular plate of the above-mentioned time setting device. The protrusion of the circular plate according to the present invention includes a first edge parallely spaced apart from the bottom of the circular plate, and a pair of second edges converging from the bottom of the circular plate to the free ends of the first edge. To produce such a plate does not require skilled and precise method, thus reducing the cost of manufacturing.

BRIEF DESCRIPTION OF THE DRAWINGS

Other features and advantages of the present invention will become more apparent in the following detailed description, including drawings, all of which show a non-limiting form of the invention, and of which:

FIG. 2 is a cross section view of the time setting device of FIG. 1, illustrating the alarm being switched on.

FIG. 5 is a cross section view of the time setting device of FIG. 3, the configuration illustrates the alarm being switched on.

DETAILED DESCRIPTION OF THE PREFERRED EMBODIMENT

Figure 1:
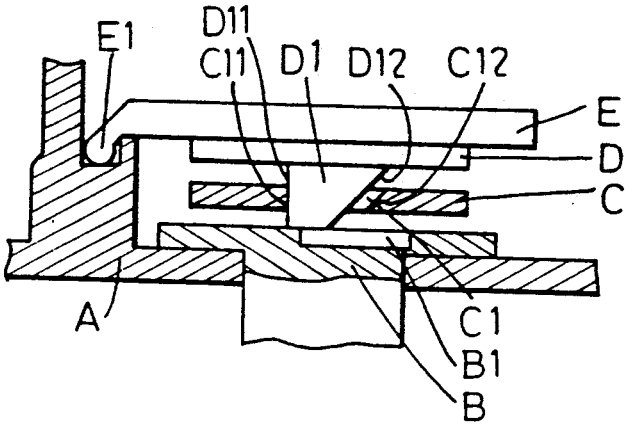
FIG. 1 (PRIOR ART)
FIG. 1 shows a cross section view of a time setting device of prior art model.
Figure 2:
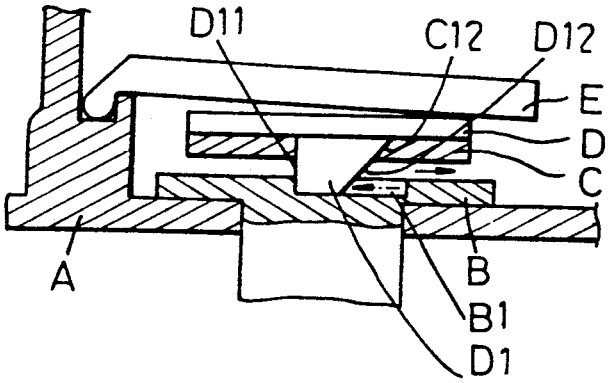
FIG. 2 (PRIOR ART)
Figure 3:
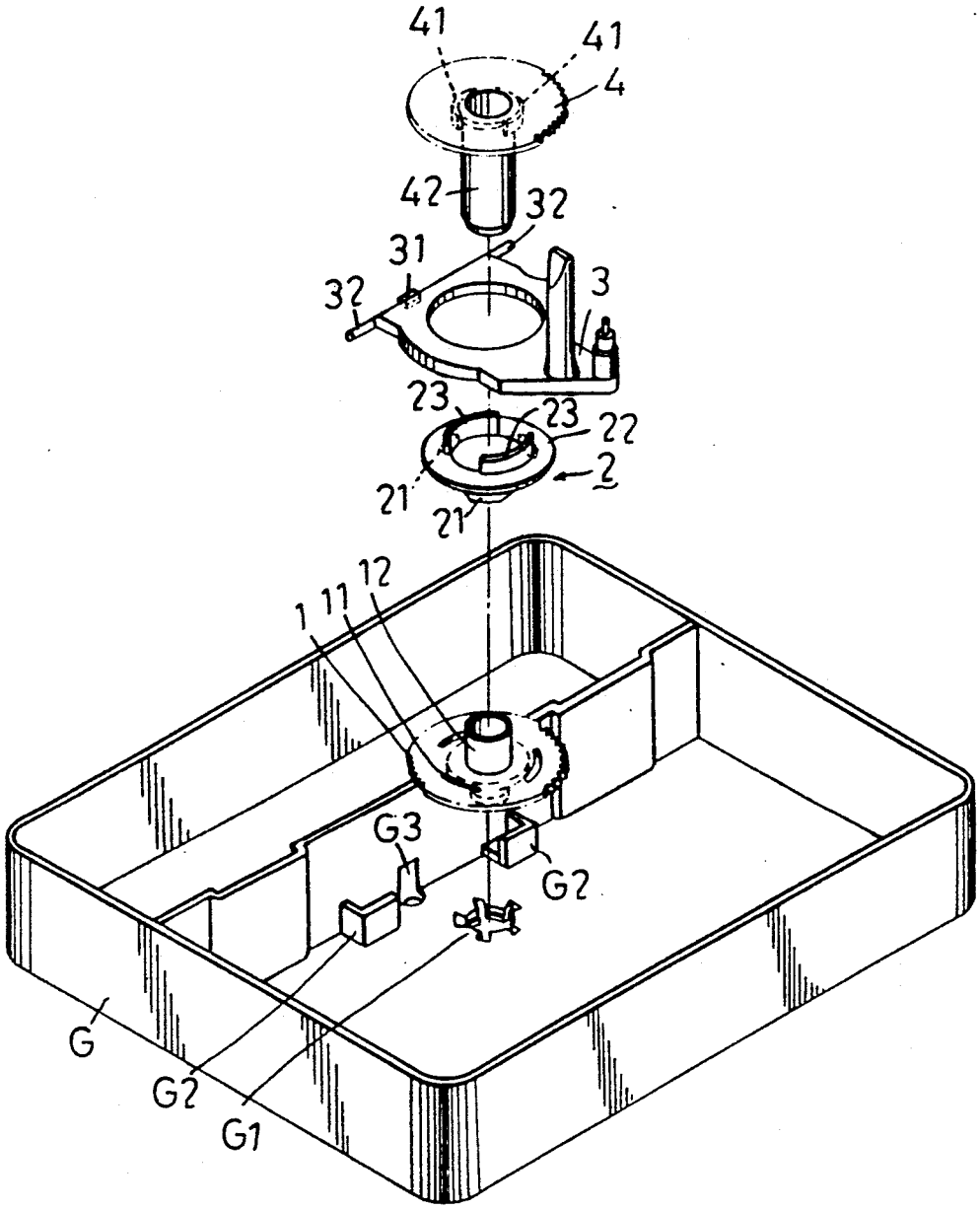
FIG. 3 is an exploded view of a time setting device of the present invention.
Figure 5:
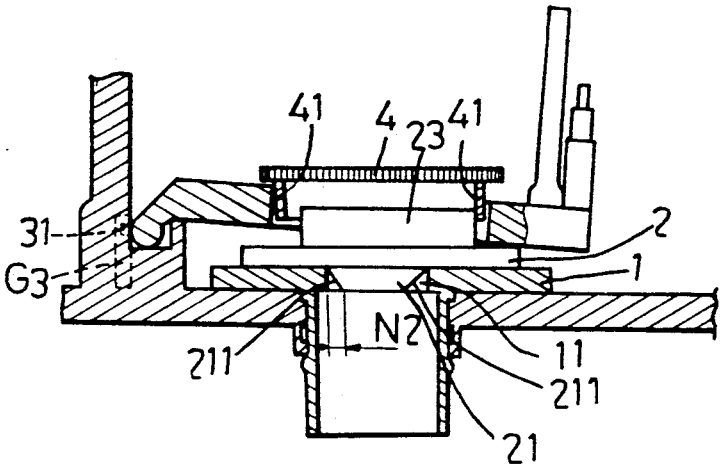

Referring to FIG. 3, a time setting device of the present invention is shown to comprise of a casing G, a time setting wheel (1), a circular plate (2), a compressed plate (3) and an hour indicating wheel.

The time setting wheel (1) has a plurality of actual grooves (11) formed therethrough, a hollow shaft including a first and a second end centrally passing through said wheel. Each of the actual grooves (11) have a different arc length and a different radius. The second end of the hollow shaft (12) has an annular protrusion (121) extended circumstantially and outwardly therefrom, so that when said second end of the hollow shaft (12) is inserted into the bottom hole G1 of the casing G, the annular protrusion 121 is lip-fit therein thus preventing said hollow shaft (12) from disengaging with said casing (G). This is possible because the casing G and shaft are made of plastics which allow some resiliency to allow said hollow shaft (12) squeezed through the bottom hole G1. Under this condition, the time setting wheel (1) is manually rotatable so that a time can be pre-set.

Figure 4:
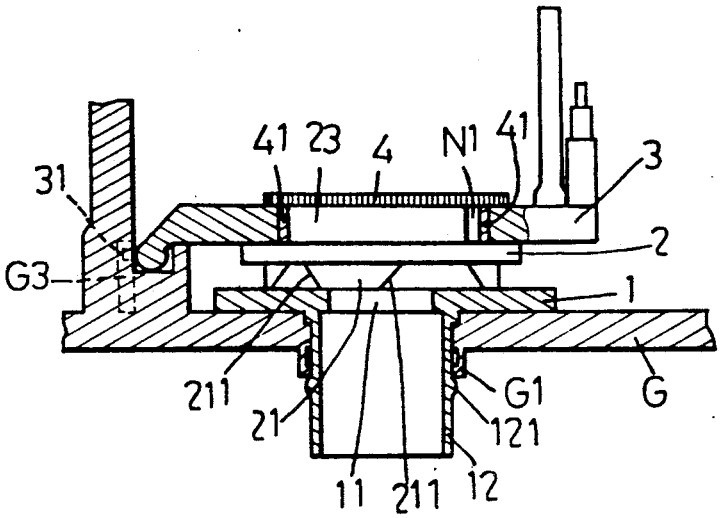
FIG. 4 is a cross section view of the time setting device of FIG. 3.

A circular plate (2) has a through-hole, a plurality of arched projections (21), correspondingly and respectively aligned with said actual grooves (11) of said setting wheel (1), and extending downward from the bottom side of the circular plate. Each arched projection (21) has an longitudinal edge and two tapered edges (211). A pair of protrusions (23) spaced apart from one another, extend upwardly from the periphery of the through-hole. The circular plate (2) is provided on the setting wheel (1) under a certain position as shown in FIG. 4, where the arched projections (21) do not fall into those actual grooves (11).

A compressed plate (3) has two arms (32) pivoted to a bracket G2 in the casing (G). A protrusion (31) disposed between said two arms, snaps into the recess G3 of the casing G. Since the compressed plate (3) has a weight, it presses the circular plate (2) when the former is provided over the latter with said protrusions (23)

extending upward through the through-hole of the compressed plate (3).

An hour indicating wheel (4) has a shaft extended therefrom and adapted to fit in the hollow shaft (12) of the setting wheel (1). The hour indicating wheel (4) also has two projection (41) spaced apart from one another and extending downward from the bottom side thereof, which have a similar curvature with said protrusion (23), so that when the shaft of the hour wheel (4) is inserted into the hollow shaft (12) of the setting wheel (1), the two projections (41) and the protrusion (23) cooperatively define a C-shaped ring therearound. Under these conditions, the compressed plate (3) is held horizontally with respect to the bottom of the casing, and a clearance N1 remains between one end of the protrusion (23) of the circular plate (2) and one end of the projections (41) of the hour indicating wheel (4). It must be understood that when the hour indicating wheel (4) rotates, the circular plate (2) is also rotated. It is so arranged that in one circulation, the projection (21) will be aligned and engaged only once with corresponding actual groove (11) of the setting wheel.

The counting relationship and clock mechanism applied in my invention are all known in the related art. Thus no explanation will be provided here.

When the hour indicating wheel (4) rotates, the circular plate (2) is also rotated. During rotating procedure, the projection (21) of the circular plate (2) will fall into the respective actual groove (11), thus electrically connecting a circuit to give out an alarm. Since the clearance N2 between the tapered edge (211) of the projection (21) and one end of the actual groove (11) equals to 1, the circular plate (2) will climb back from the arual groove (11) when the hour indicating wheel (4) continues to rotates a distance of N1.

Alternatively, the projection (21) of the circular plate (2) be released from the actual groove (11) when the setting wheel (4) is manually rotated. That is to say that manually rotating the setting wheel (1) in a clockwise or anti-clockwise directions. This is made possible because of the tapered edges (211) of the circular plate (2).

It has been found that during mass production of the time setting device of the present invention, very component used in the present setting device can be produced by simple voids, consequently reducing the over all manufacturing cost. Simultaneously, this present invention provide a punctual pre-set time.

With the invention thus explained, it is obvious to those skilled in the are that various modifications and variations can be made without departing from the scope and spirit of the present invention. It is therefore intended that this invention be limited only as in the appended claims.

I claim:

1. A time setting device for an alarm clock including a casing with a bottom and having a time setting wheel, a circular plate, a compressed plate and an hour indicating wheel provided is said casing, said time setting wheel has an arcuate groove, an upper face, a lower face and a hollow shaft including a first end and a second end centrally extending through said setting wheel, said second end of sad hollow shaft being inserted into said bottom of said casing, said setting wheel being manually rotatable with respect to said bottom of said casing, said comprised plate has an edge pivotally connected to a partition of said casing;

characterized in that said circular plate has a through-hole and having a top side with an arched projection extending upwardly from the periphery of said hole and a bottom side with a first arched projection extending downwardly therefrom and aligned with said arcuate groove of said time setting wheel, said first arched projection including a first edge spaced parallel apart from said bottom side of said circular plate and a pair of second edges which converge from said bottom side of said circular plate to the free ends of said first edge respectively, said circular plate being provided of said time setting wheel with said first arched projection being in said arcuate groove and said first end of said hollow shaft extending through said through-hole of said circular plate;

said compressed plate further has a through-hole and being provided over said circular plate with said arched projection of said circular plate extending through said through-hole of said compressed plate;

said hour indicating wheel has a shaft centrally extending therefrom and a second arched projection similarly extending from said hour indicating wheel, said shaft passing through said through-holes of said compressed plate and said circular plate and being inserted into said hollow shaft of said setting wheel wherein said second a ched projection of said hour indicating wheel and said arched projections of said circular plate cooperatively confining a C-shaped flange with a clearance being formed between two free end of said C-shaped flange.

2. A time setting device as claimed in claim 1, characterized in that said second end of said hollow shaft has an annular protrusion extending circumstantially and radially thereof.

* * * * *